US005775882A

United States Patent [19]

Kiyokawa et al.

[11] Patent Number: 5,775,882

[45] Date of Patent: Jul. 7, 1998

[54] MULTICYLINDER ROTARY COMPRESSOR

[75] Inventors: Yasunori Kiyokawa, Gunma-ken; Jisuke Saito, Tochigi-ken, both of Japan

[73] Assignee: Sanyo Electric Co., Ltd., Osaka, Japan

[21] Appl. No.: 594,247

[22] Filed: Jan. 30, 1996

[30] Foreign Application Priority Data

Jan. 30, 1995 [JP] Japan ..... 7-012861

[51] Int. Cl.[6] ..... F04B 49/00

[52] U.S. Cl. ..... 417/310; 417/287; 417/299; 418/11

[58] Field of Search ..... 418/11, 60; 417/285, 417/286, 287, 299, 310

[56] References Cited

U.S. PATENT DOCUMENTS

| | | | |
|---|---|---|---|
| 4,452,570 | 6/1984 | Fujisaki et al. | 417/310 |
| 4,452,571 | 6/1984 | Koda et al. | 417/310 |
| 4,494,373 | 1/1985 | Nagatomo et al. . | |
| 4,726,739 | 2/1988 | Saitou et al. | 417/310 |
| 4,780,067 | 10/1988 | Suzuki et al. . | |
| 5,152,156 | 10/1992 | Tokairin . | |

FOREIGN PATENT DOCUMENTS 0 222 109 5/1987 European Pat. Off. .

*Primary Examiner*—Charles G. Freay

*Attorney, Agent, or Firm*—Darby & Darby

[57] ABSTRACT

A multicylinder rotary compressor capable of performing high performance capacity control operation without the need for an external piping or for a thicker partition plate which leads to a taller rotary compressing element or a longer bearing span of a bearing. The multicylinder rotary compressor has a rotary compressing element housed in a hermetic enclosure; wherein the rotary compressing element is equipped with an intermediate partition plate, a cylinder provided on each side of the partition plate, a rotary shaft having eccentric sections which are shifted relative to each other by 180 degrees in the direction of shaft rotation, rollers fitted onto the eccentric sections of the rotary shaft and which rotate in the cylinders, and bearings which seal the cylinders. A first aperture is provided in the inner wall of each of the two cylinders, a second aperture is provided in each of the two cylinders to communicate with the respective cylinder first aperture, and a third aperture in the intermediate partition plate to communicate with the two second apertures. A gas which is being compressed in one cylinder flows, via the first, second, and third apertures, into the other cylinder which is in an intake stroke.

5 Claims, 5 Drawing Sheets

MULTICYLINDER ROTARY COMPRESSOR

BACKGROUND OF THE INVENTION

1. Field of the Invention

The present invention relates to a multicylinder rotary compressor which is equipped with a plurality of cylinders and which enables capacity control operation.

2. Description of the Related Art

This type of conventional multicylinder rotary compressor is configured as disclosed in, for example, Japanese Patent Publication No. 6-33782. The multicylinder rotary compressor will be described with reference to FIG. 7.

Reference number 1 denotes a hermetic enclosure containing an electric element 3 which has a rotary shaft 2 and which is located on the upper side and a rotary compressing element 4 which is located on the lower side and which is driven by the electric element. The rotary compressing element 4 is constructed by an intermediate partition plate 5, cylinders 6 and 7 mounted at the top and bottom, respectively, of the partition plate 5, eccentric sections 8 and 9 which are mounted on the rotary shaft 2 with 180 degrees shifted in angle of rotation, rollers 10 and 11 which are rotated in the cylinders 6 and 7, respectively, by the eccentric sections, an upper bearing 12 and a lower bearing 13 which seal the openings of the cylinders 6 and 7, respectively, and cup mufflers 14 and 15 installed to the upper bearing 12 and the lower bearing 13, respectively.

The cup muffler 14 of the upper bearing 12 is provided with a discharge port 21 which opens to a chamber 20 formed between the electric element 3 and the rotary compressing element 4. Reference numeral 22 denotes a discharge tube installed to the top wall of the hermetic enclosure 1.

A certain compressor of this type is designed to enable capacity control operation by providing the rotary compressing element 4 with a passage 23 for releasing a part of a gas, which is being compressed, installing a control valve 25 in the passage, and communicating the passage to the low pressure side of an external refrigerant circuit via a connecting tube 24.

Another version has apertures 30, 31, and 32 and a piston 33 in the partition plate 5 in constructing the aforesaid capacity control unit as disclosed in Japanese Patent Laid-Open No. 62-7086.

The structure of the capacity control unit will be described with reference to FIG. 8 and FIG. 9. The partition plate 5 is provided with first apertures 30 and 31 which open to the cylinders 6 and 7 and also provided with a second aperture 32 which is communicated with the first apertures 30 and 31 and which contains the piston 33 and a coil spring 34 for urging the piston, and further provided with a third aperture 35 which is communicated with the second aperture 32 and also communicated selectively with the low pressure side or the high pressure side of the external refrigerant circuit.

With the arrangement stated above, when low pressure is applied as a back pressure to the piston 33, the piston 33 moves to the right in FIG. 8, causing the first apertures 30 and 31 to communicate with the second aperture 32, so that a gas flows from the cylinder 6, which is in the compression stroke, to the cylinder 7, which is in the intake stroke, thereby performing capacity control operation. When high pressure is applied as the back pressure to the piston 33, the piston 33 moves to the left in FIG. 9, breaking the communication between the first apertures 30 and 31 and the second aperture 32, so that the gas no longer moves and the normal operation is resumed.

The former conventional capacity control unit, however, requires a thick piping such as the connecting tube 24 to take the gas out of the compressor and also a long piping for connecting the compressor to the piping on the low pressure side of the external refrigerant circuit. This poses problems of higher manufacturing cost, a more complicated piping configuration, and lower capacity control efficiency because of the larger gas passage resistance.

The latter conventional capacity control unit is designed so that no gas is allowed to go out of the compressor during the capacity control. Therefore, the capacity control factor is not decreased when the number of pipes is increased; however, a piston 33 and a coil spring 34 provided in a partition plate 5 inevitably add to the thickness of the partition plate 5. This results in an increased height of a rotary compressing element 4 with a consequent increased height of the compressor, a longer bearing span of bearings 12 and 13, leading to deteriorated strength of a rotary shaft 2.

SUMMARY OF THE INVENTION

Accordingly, it is an object of the present invention to provide a multicylinder rotary compressor capable of performing high-performance capacity control operation without the need for an external piping or a thicker partition plate which leads to a taller rotary compressing element or a longer bearing span of a bearing.

To this end, according to one aspect of the present invention, there is provided a multicylinder rotary compressor comprising: a rotary compressing element housed in a hermetic enclosure, the rotary compressing element being equipped with an intermediate partition plate, cylinders provided on both sides of the partition plate, a rotary shaft having eccentric sections which are shifted against each other by 180 degrees in the angle of rotation, rollers which are fitted onto the eccentric sections of the rotary shaft and which rotate in the cylinders, and bearings which seal the openings of the cylinders; first apertures provided in the inner walls of the aforesaid two cylinders; second apertures provided in the above two cylinders so that they communicate with the first apertures; and a third aperture provided in the intermediate partition plate so that it communicates with the two second apertures; wherein a gas which is being compressed in one cylinder is allowed to flow, via the first, second, and third apertures, into the other cylinder which is in the intake stroke.

With this arrangement, the apertures, pistons, spring, etc. required for a capacity control mechanism can be arranged in the cylinders so as to reduce the thickness of the partition plate, the height of the rotary compressing element, and the bearing span of the bearings, thus making it possible to provide a compact multicylinder rotary compressor which is capable of implementing high-performance capacity control operation.

According to another aspect of the present invention, there is provided a multicylinder rotary compressor comprising: a rotary compressing element housed in a hermetic enclosure, the rotary compressing element being equipped with an intermediate partition plate, cylinders provided on both sides of the partition plate, a rotary shaft having eccentric sections which are shifted against each other by 180 degrees in the angle of rotation, rollers which are fitted onto the eccentric sections of the rotary shaft and which rotate in the cylinders, and bearings which seal the openings of the cylinders; first apertures provided in the inner walls of the aforesaid two cylinders; second apertures provided in the above two cylinders so that they communicate with the first apertures; a third aperture provided in the intermediate partition plate so that it communicates with the two second apertures; pistons disposed in the second apertures in the two cylinders; and an elastic piece which extends to the two pistons; wherein low pressure or high pressure is selectively applied to the second apertures to slide the two pistons so as to open or close the two first apertures, thereby allowing a gas, which is being compressed in one cylinder, to flow into the other cylinder, which is in the intake stroke, via the first, second, and third apertures.

With this arrangement, the pistons for controlling the capacity can be relatively arranged in the two cylinders to share a single spring, thus reducing the number of components. In addition, coaxial machining is possible for making the second apertures in which the pistons and spring are disposed and the apertures can be positioned more accurately.

According to still another aspect of the present invention, there is provided a multicylinder rotary compressor comprising: a rotary compressing element housed in a hermetic enclosure, the rotary compressing element being equipped with an intermediate partition plate, cylinders provided on both sides of the partition plate, a rotary shaft having eccentric sections which are shifted against each other by 180 degrees in the angle of rotation, rollers which are fitted onto the eccentric sections of the rotary shaft and which rotate in the cylinders, and bearings which seal the openings of the cylinders; first apertures provided in the inner walls of the aforesaid two cylinders; second apertures provided in the above two cylinders so that they communicate with the first apertures; a third aperture provided in the intermediate partition plate so that it communicates with the two second apertures, pistons disposed in the second apertures of the two cylinders; an elastic piece which extend to the two pistons; fourth apertures formed in the two cylinders so that they communicate with the second apertures of the two cylinders through the recesses formed at least in the cylinders or bearings; and a passage for selectively communicating the fourth apertures with the low pressure side or the high pressure side of an external refrigerant circuit; wherein low pressure or high pressure is selectively applied to the second apertures to slide the two pistons so as to open or close the two first apertures, thereby allowing a gas, which is being compressed in one cylinder, to flow into the other cylinder, which is in the intake stroke, via the first, second, and third apertures.

With this arrangement, the passages for applying back pressure to the capacity control pistons are configured in the two cylinders with respect to the partition plate so as to evenly apply the back pressure to the two pistons at all times. This makes it possible to simultaneously actuate the two pistons in good balance, leading to improved performance of capacity control. Moreover, the second and fourth apertures, which are major apertures, are formed in the axial direction of the two cylinders, enabling improved workability.

According to a further aspect of the present invention, there is provided a multicylinder rotary compressor comprising: a rotary compressing element housed in a hermetic enclosure, the rotary compressing element being equipped with an intermediate partition plate, cylinders provided on both sides of the partition plate, a rotary shaft having eccentric sections which are shifted against each other by 180 degrees in the angle of rotation, rollers which are fitted onto the eccentric sections of the rotary shaft and which rotate in the cylinders, and bearings which seal the openings of the cylinders; first apertures provided in the inner walls of the aforesaid two cylinders; second apertures provided in the above two cylinders so that they communicate with the first apertures; a third aperture provided in the intermediate partition plate so that it communicates with the two second apertures; pistons disposed in the second apertures in the two cylinders; and elastic pieces disposed in the second apertures so as to urge the two pistons; wherein low pressure or high pressure is selectively applied to the second apertures to slide the two pistons so as to open or close the two first apertures, thereby allowing a gas, which is being compressed in one cylinder, to flow into the other cylinder which is in the intake stroke via the first, second, and third apertures.

With this arrangement, the spring can be made shorter and the load applied to the spring can be reduced. The result is greater freedom in the design of the spring and higher reliability of the capacity control unit.

DETAILED DESCRIPTION OF THE PREFERRED EMBODIMENTS

The present invention will now be described with reference to FIG. 1 through FIG. 6.

Figure 7:
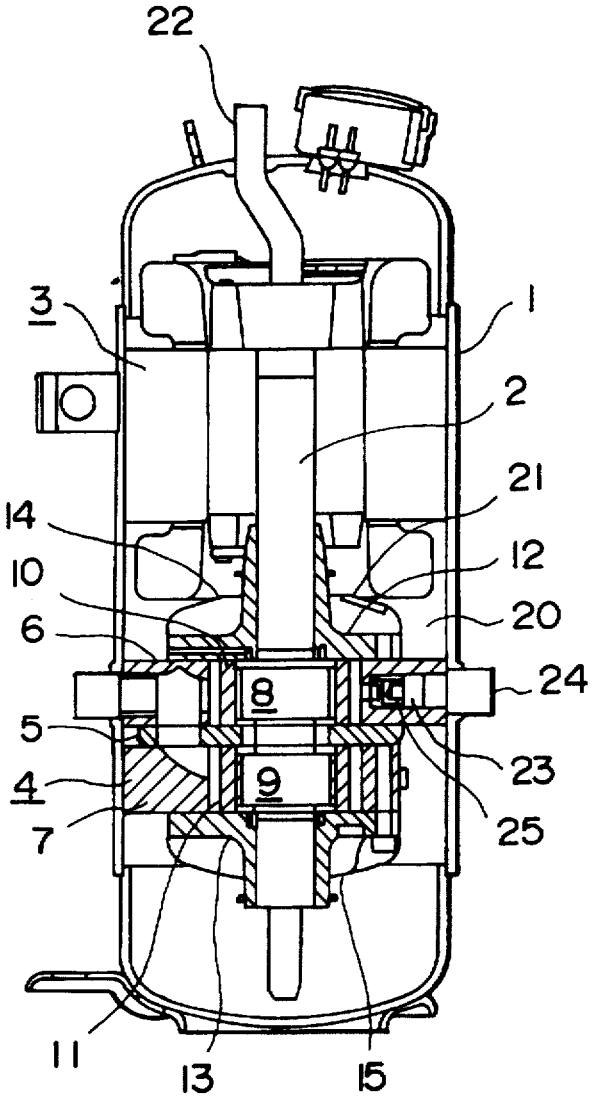
FIG. 7 PRIOR ART
FIG. 7 is a longitudinal cross-sectional view showing a conventional multicylinder rotary compressor.
Figure 8:
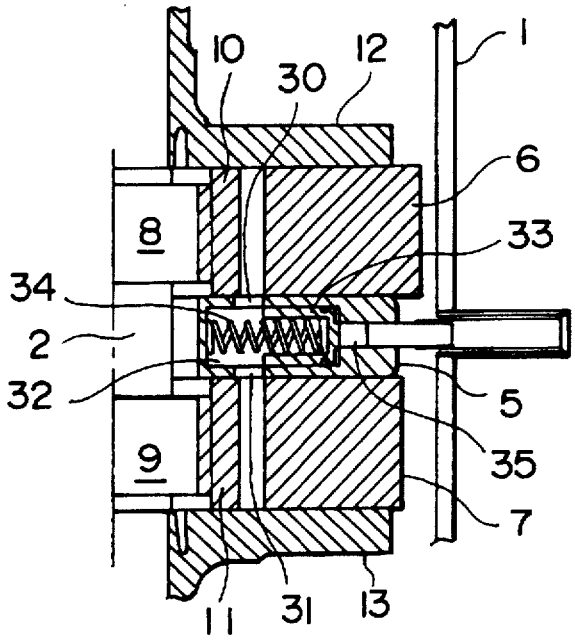
FIG. 8 PRIOR ART
FIG. 8 is a longitudinal section view illustrating an essential part of another conventional multicylinder rotary compressor in the capacity control operation mode.
Figure 9:
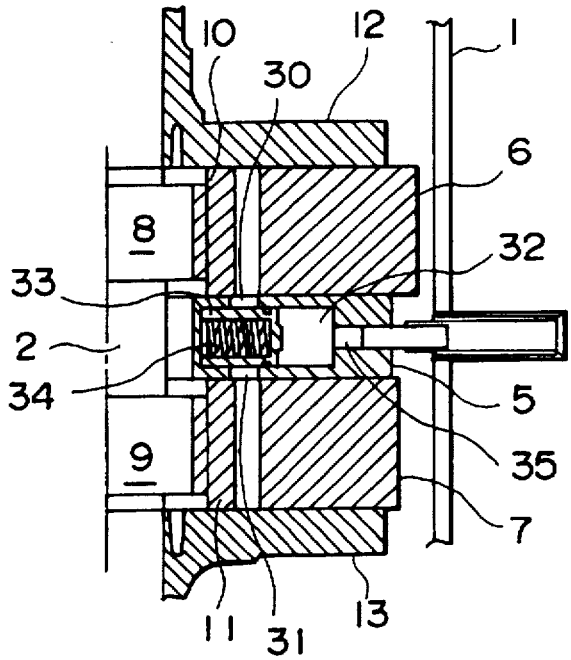
FIG. 9 PRIOR ART
FIG. 9 illustrates an operation state of the conventional multicylinder rotary compressor of FIG. 8 in the normal operation mode.

The structure which is not related to the capacity control unit is identical to that of the conventional example shown in FIG. 7; therefore, the same reference numerals used in FIG. 7 are applied and the description thereof will be omitted.

Figure 1:
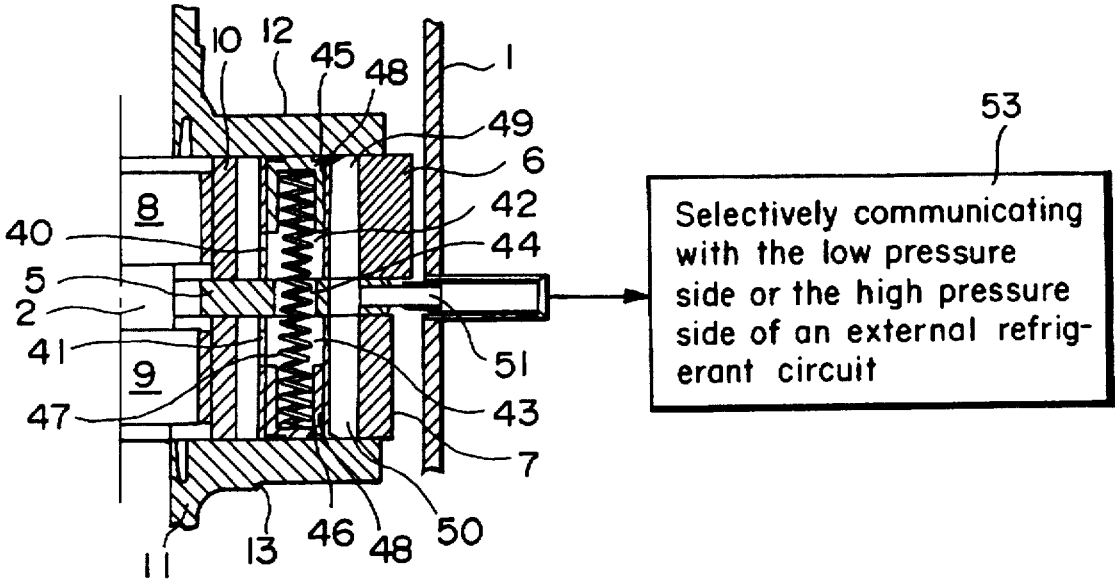
FIG. 1 is a longitudinal section view illustrating an essential part of a multicylinder rotary compressor according to the present invention in a capacity control operation mode.

FIG. 1 is the longitudinal section view illustrating the capacity control unit of the multicylinder rotary compressor.

Figure 2:
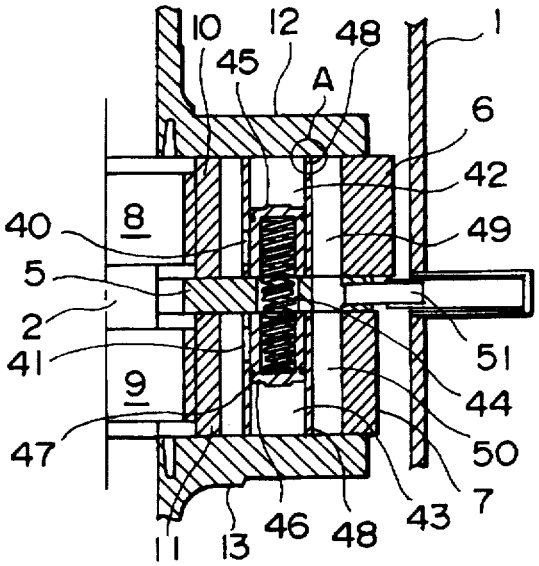
FIG. 2 illustrates an operation state of the essential part shown in FIG. 1 in a normal operation mode.
Figure 3:
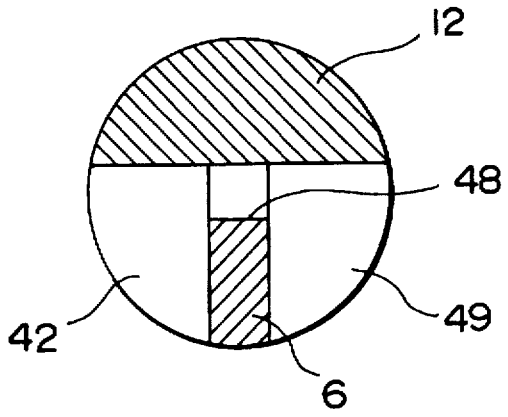
FIG. 3 is an enlarged crosssectional view illustrative of section A of FIG. 2.

The capacity control unit is provided with: first apertures 40, 41 provided in the inner walls of the two cylinders 6, 7, respectively; second apertures 42, 43 provided in the cylinders 6, 7 so that they communicate with the first apertures 40, 41; a third aperture 44 provided in the intermediate partition plate 5 so that it communicates with the two second apertures 42, 43; pistons 45, 46 enclosed in the second apertures 42, 43 of the two cylinders 6, 7; a coil spring 47 (a leaf spring or bellows may be used as long as it is an elastic body) which extends into both pistons 45, 46; fourth apertures 49, 50 which are formed in the cylinders 6, 7 so that they communicate with the second apertures 42, 43 of the cylinders 6, 7 through recesses 48 (indicated by A in FIG. 2; an enlarged view thereof is shown in FIG. 3) formed in the cylinders 6, 7; and a passage 51 for selectively communicate the fourth apertures 49, 50 with the low pressure side or the high pressure side of an external refrigerant circuit 53, through a selector valve or the like.

Figure 4:
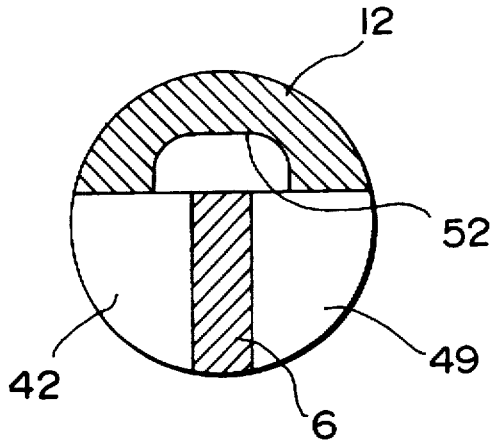
FIG. 4 is an enlarged cross-sectional view illustrative of another embodiment of section A.

The recesses 48 in the cylinders 6, 7 may be formed as recesses 52 at the end surfaces of the bearings 12, 13 as shown in FIG. 4 for the communication with the fourth apertures 49, 50.

When the capacity control unit performs the capacity control, as illustrated in FIG. 1, the pressure on the low pressure side is applied as the back pressure to the second apertures 42, 43 via the passage 51, the fourth apertures 49, 50, and the recesses 48 to move the pistons 45, 46 to the top dead centers so as to release the first apertures 40, 41, thereby allowing the gas, which is being compressed in the cylinder 6, into the cylinder 7, which is in the intake stroke, via the first aperture 40, the second aperture 42, the third aperture 44, the second aperture 43, and the first aperture 41. For normal operation, as illustrated in FIG. 2, the pressure at the high pressure side is applied as the back pressure to the second apertures 42, 43 via the passage 51, the fourth apertures 49, 50, and the recesses 48 to move the pistons 45, 46 to the bottom dead centers so as to close the first apertures 40, 41, thereby preventing the gas from moving between the two cylinders 6, 7.

With this arrangement, the apertures 40, 41, 42, 43, 44, 49 and 50, pistons 45 and 46, the spring 47, etc. required for the capacity control mechanism can be arranged in the cylinders 6 and 7 so as to reduce the thickness of the partition plate 5, the height of the rotary compressing element 4, and the bearing span of the bearings 12 and 13, thus making it possible to provide a compact multicylinder rotary compressor which is capable of implementing high-performance capacity control operation.

Further, the pistons 45, 46 for controlling the capacity can be relatively arranged in both cylinders 6, 7 so as to share the spring 47, thus reducing the number of components. In addition, coaxial machining is possible for making the second apertures 42, 43 in which the pistons 45, 46 and the spring 47 are disposed and the apertures can be positioned more accurately.

Furthermore, the fourth apertures 49, 50 for applying the back pressure to the capacity control pistons 45, 46 are configured in the two cylinders 6, 7 with respect to the partition plate 5 so as to evenly apply the back pressure to the two pistons 45, 46 at all times. This makes it possible to simultaneously actuate the two pistons 45, 46 in good balance, leading to improved performance of capacity control. Moreover, the second apertures 42, 43 and the fourth apertures 49, 50, which are major apertures, are formed in the axial direction of the two cylinders 6, 7, enabling improved workability.

Figure 5:
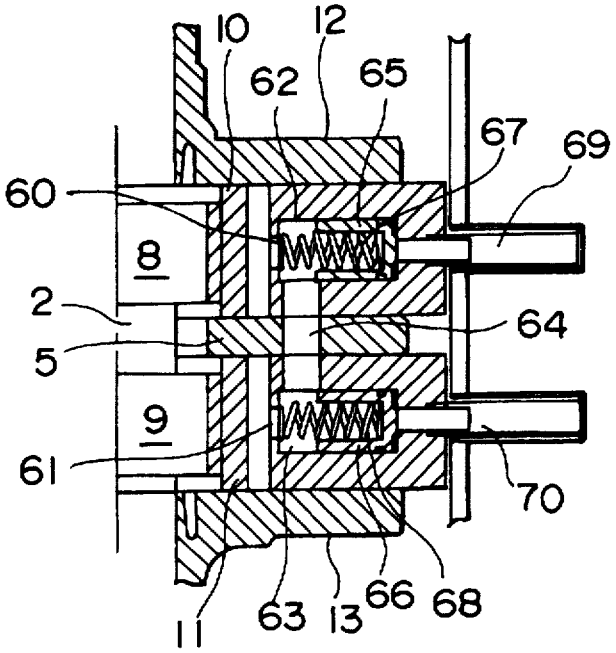
FIG. 5 is a longitudinal section view illustrating an essential part of a multicylinder rotary compressor according to another embodiment when it is in the capacity control operation mode.
Figure 6:
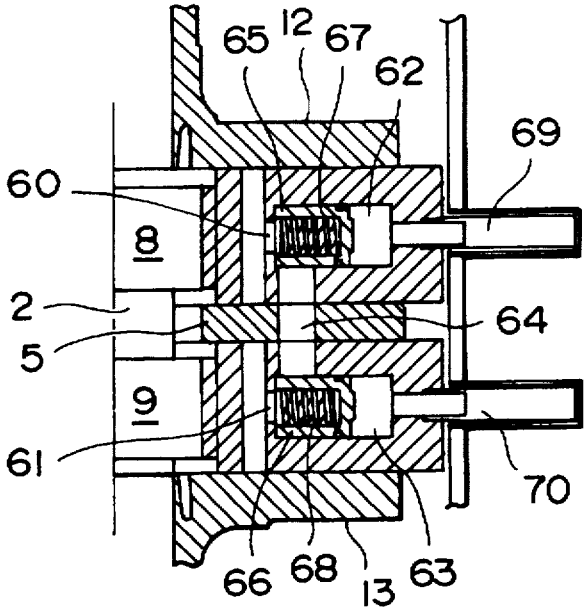
FIG. 6 illustrates an operation state of the essential part shown in FIG. 5 in the normal operation mode.

FIG. 5 and FIG. 6 show another embodiment which is equipped with: first apertures 60, 61 provided in the inner walls of the cylinders 6, 7; second apertures 62, 63 provided in the cylinders 6, 7 so that they communicate with the first apertures; a third aperture 64 provided in the intermediate partition plate 5 so that it communicates with the two second apertures 62, 63; pistons 65, 66 placed in the second apertures 62, 63 of the cylinders 6, 7; and coil springs 67, 68 disposed in the second apertures 62, 63 so that they urge the pistons 65, 66; wherein the low pressure or high pressure is selectively applied from an external refrigerant circuit to the second apertures 62, 63 via two piping passages 69, 70 so as to slide the pistons 65, 66 to open or close the first apertures 60, 61, thereby allowing the gas, which is being compressed in one cylinder 6 or 7, to the other cylinder 6 or 7, which is in the intake stroke, via the first apertures 60, 61, the second apertures 62, 63, and the third aperture 64.

With this arrangement, the provision of the two separate coil springs 67, 68 enables the respective springs to be made shorter and the load applied to the springs to be reduced, thus enhancing the freedom in designing the springs and also achieving higher reliability of the capacity control unit.

Thus, according to the present invention, the structure makes it possible to dispose the apertures, pistons, springs, etc. required for the capacity control mechanism in the cylinders so as to reduce the thickness of the partition plate, the height of the rotary compressing element, and the bearing span of the bearings. The result is a compact multicylinder rotary compressor which is capable of implementing high-performance capacity control operation.

Further, the structure makes it possible to relatively arrange the capacity control pistons so that they extend to the two cylinders to share a single spring, thus reducing the number of components. In addition, coaxial machining is possible for making the second apertures in which the pistons and spring are placed and the apertures can be positioned more accurately.

Furthermore, the structure makes it possible to relatively arrange the passages, through which the back pressure is applied to the capacity control pistons, in the two cylinders with respect to the partition plate so as to evenly apply the back pressure to the two pistons at all times. This makes it possible to simultaneously actuate the two pistons in good balance, leading to improved performance of capacity control. Moreover, the second and fourth apertures, which are major apertures, are formed in the axial direction of the two cylinders, enabling improved workability.

In addition, the structure makes it possible to shorten the length of the springs and reduce the load applied to the springs, thus achieving greater freedom in designing the springs and also improved reliability of the capacity control unit.

What is claimed is:

1. A multicylinder rotary compressor comprising:

a rotary compressing element housed in a hermetic enclosure, said rotary compressing element having an intermediate partition plate, a cylinder on each side of said partition plate, each cylinder having an open end, a rotary shaft having eccentric sections shifted relative to each other by 180 degrees in the direction of shaft rotation, rollers on said eccentric sections of said rotary shaft which rotate in said cylinders, and bearings which seal said open ends of said cylinders;

a first aperture in the inner wall of each said two cylinders;

a second aperture in each said cylinder to communicate with the respective first aperture; and a third aperture in said intermediate partition plate to provide communication between said two second apertures; and a valve operating to permit a gas being compressed in one of said cylinders to flow, via said first, second, and third apertures into the other of said cylinders which is in an intake stroke.

2. A multicylinder rotary compressor comprising:

a rotary compressing element housed in a hermetic enclosure, said rotary compressing element having an intermediate partition plate, a cylinder on each side of said partition plate, each cylinder having an open end, a rotary shaft having eccentric sections shifted relative to each other by 180 degrees in the direction of shaft rotation, rollers on said eccentric sections of said rotary shaft which rotate in said cylinders, and bearings which seal said open ends of said cylinders;

a first aperture in the inner wall of each of said two cylinders;

a second aperture in each of said two cylinders to communicate with the respective first aperture;

a third aperture in said intermediate partition plate that communicates with said two second apertures;

a piston disposed in each said second aperture of said two cylinders; and an elastic body between said two pistons; wherein low pressure or high pressure is selectively applied to said second apertures to slide said two pistons to open or close said two first apertures, thereby allowing a gas which is being compressed in one cylinder to flow, via the first, second, and third apertures, into the other cylinder which is in an intake stroke.

3. A multicylinder rotary compressor as in claim 2 wherein each of said fourth apertures comprise a recess formed at least in said cylinder or bearing.

4. A multicylinder rotary compressor comprising:

a rotary compressing element housed in a hermetic enclosure, said rotary compressing element having an intermediate partition plate, a cylinder on each side of said partition plate, each cylinder having an open end, a rotary shaft having eccentric sections shifted relative to each other by 180 degrees in the direction of shaft rotation, rollers fitted on said eccentric sections of said rotary shaft to rotate in said cylinders, and bearings which seal said open ends of said cylinders;

a first aperture in the inner wall of each of said two cylinders;

a second aperture in each of said cylinders to communicate with the respective first aperture;

a third aperture in said intermediate partition plate that communicates with said two second apertures;

a piston disposed in the second aperture of each of said cylinders;

an elastic body extending into said two pistons;

a fourth aperture formed in each of said two cylinders to communicate with said second aperture of the respective two cylinder, and a passage for selectively communicating said fourth apertures with the low pressure side or the high pressure side of an external refrigerant circuit; wherein low pressure or high pressure is selectively applied to said second apertures to slide said two pistons to open or close said first apertures, thereby allowing a gas, which is being compressed in one cylinder, to flow, via the first, second, and third apertures, into the other cylinder which is in an intake stroke.

5. A multicylinder rotary compressor comprising:

a rotary compressing element housed in a hermetic enclosure, said rotary compressing element having an intermediate partition plate, a cylinder on each side of said partition plate, each cylinder having an open end, a rotary shaft having eccentric sections which are shifted relative to each other by 180 degrees in the direction of shaft rotation, rollers fitted onto said eccentric sections of said rotary shaft which rotate in said cylinders, and bearings which seal said open ends of said cylinders;

a first aperture provided in the inner wall of each of said two cylinders;

a second aperture in each of said two cylinders to communicate with the respective first aperture;

a third aperture in said intermediate partition plate that communicates with said second aperture;

a piston disposed in the second aperture of each of said two cylinders; and an elastic body in said second apertures to urge said two pistons to close said first aperture; wherein low pressure or high pressure is selectively applied to said respective second apertures to slide said two pistons in order to open or close said first apertures, thereby allowing a gas, which is being compressed in one cylinder, to flow, via the first, second, and third apertures into the other cylinder, which is in an intake stroke.

* * * * *